US006738483B1

(12) United States Patent
Betts

(10) Patent No.: US 6,738,483 B1
(45) Date of Patent: May 18, 2004

(54) OVERHEAD LOUDSPEAKER SYSTEMS

(75) Inventor: Robert W. Betts, Shelton, CT (US)

(73) Assignee: Sonic Systems, Inc., Stratford, CT (US)

( * ) Notice: Subject to any disclaimer, the term of this patent is extended or adjusted under 35 U.S.C. 154(b) by 380 days.

(21) Appl. No.: 09/686,723

(22) Filed: Oct. 11, 2000

Related U.S. Application Data

(60) Provisional application No. 60/159,045, filed on Oct. 12, 1999.

(51) Int. Cl.[7] ..... H04R 25/00
(52) U.S. Cl. ..... 381/160; 381/337
(58) Field of Search ..... 381/345–350, 381/352–354, 160; 181/155–156; 379/430–440

(56) References Cited

U.S. PATENT DOCUMENTS 5,058,154 A * 10/1991 Andersen ..... 379/433.02
5,155,773 A * 10/1992 Hansen ..... 381/393
5,266,752 A * 11/1993 Cussans ..... 181/155
5,440,630 A * 8/1995 Yamaguchi et al. ..... 379/437
5,491,747 A * 2/1996 Bartlett et al. ..... 379/433.03
5,673,329 A * 9/1997 Wiener ..... 381/160
5,886,304 A * 3/1999 Schlenzig et al. ..... 181/155

* cited by examiner

*Primary Examiner*—Curtis Kuntz
*Assistant Examiner*—P. Dabney
(74) *Attorney, Agent, or Firm*—Melvin I. Stoltz

(57) ABSTRACT

An overhead loudspeaker system is achieved which controls and shapes the ultimate acoustical wave form produced thereby, by providing at least one loudspeaker driver, mounted in a housing or enclosure, and a uniquely constructed wave shaping and controlling member formed as an integral component of the speaker assembly. In this way, broad band, acoustical wave shaping and control is realized. In accordance with a present invention, the wave shaping/controlling member is cooperatively associated with the drivers of the loudspeaker in a way which effects the critical acoustical loading and atmospheric coupling thereof, while controlling and shaping the ultimate acoustical wave form so that a hemispherical polar coverage pattern results. In the preferred configuration, the polar coverage pattern produced by the present invention is provided across the loudspeaker system's entire power bandwidth, beginning at an approximate distance of about three times the diameter of the acoustical source.

7 Claims, 7 Drawing Sheets

OVERHEAD LOUDSPEAKER SYSTEMS

This application claims the benefit of provisional application Ser. No. 60/159,045, filed Oct. 12, 1999.

BACKGROUND ART

Loudspeakers are widely used for providing projection of voice and music in a variety of areas and for numerous purposes. One area in which loudspeakers are particularly important and have had substantial difficulty in providing good results is in large public areas. In such locations, the use of conventional loudspeakers is common, but there are difficulties because of the directional nature of the speakers' sound projection. As a result, in order to assure maximum coverage, numerous or multiple speakers are employed with overlapping coverage areas which requires proper application engineering and often considerable expense to attain the desired results.

In an attempt to reduce the necessity of having numerous loudspeaker components installed to provide the desired coverage, loudspeakers having a hemispherical coverage pattern have been developed. Although many of these prior art loudspeakers had been able to provide a projection of voice and music over a wider listening area, numerous problems have continued to exist in producing products which achieve a true full frequency hemispherical sound projection pattern from a single overhead sound source, particularly in areas having a low ceiling.

One of the principal problems which has plagued prior art spherical coverage loudspeakers as well as conventional loudspeakers centers on the physical characteristics of acoustic wave patterns. In this regard, audio frequencies essentially occupy 11 octaves of the electromagnetic spectrum, with acoustical wave lengths varying across a ratio of more than 2000 to 1 (about 113 feet to about ½ in.). In most applications, a more reasonable and workable ratio is 1000 to 1 (about 56 feet to 0.68 inches). Regardless of which ratio is employed, it is apparent, due to their very nature, that these extremes of wave-length energy require the application and use of completely different areas and aspects of the laws of acoustical physics.

Another problem inherent in providing optimum projection of voice and music is the fact that lower frequencies of the audio spectrum produce spherical waves which tend to be fluid in nature and difficult to control in terms of shaping and directing. Furthermore, higher frequencies develop planar waves which exhibit directional characteristics and are, by their very nature, not easily dispersed or diffused into broad coverage patterns. Finally, midrange frequencies produce various combinations of these two extremes.

In attempting to overcome these prior art problems, while also providing maximum area coverage, spherical loudspeaker systems with shaped dishes or "reflectors" suffer from one or more shortcomings. One such common problem is a severe decrease of high frequency energy distribution at the wider points of coverage, typically beginning at about 45 degrees from the central axis. Another common problem is a significant increase in phase distortion from unwanted multiple reflections occurring between the sound source and the reflector, as well as a significant increase in intermodulation distortion due to the remodulation of one-wave by another of a different frequency. Furthermore, high intensity lobes of acoustic energy are often produced directly on axis with the reflector, expanding as wide as 20 to 30 degrees from the central axis.

Another problem typically countered with prior art overhead loudspeaker systems is the inability of such speaker systems to function as desired in low ceiling environments. Typically, in most applications, a low ceiling encompasses ceiling heights ranging between about 8 and 15 feet. In these applications, overhead loudspeaker system encounter substantially increased acoustical polar distribution problems due to the shorter linear distance between the sound source and the listener's ears. Typically, in a low ceiling environment, the listener is placed within the acoustical "near field" of the system where some, if not all, of the acoustical components of the loudspeaker are present at any one given point in space.

Typically, the "far field" boundary is considered to begin, within the spatial field, at a point where the summation wave presents all of the attributes of the system's design. The acoustical pattern shaping effects of the otherwise true hemispherical coverage loudspeaker system do not exist within the near field, but are present in their proper form and function in the far field. The summation wave defines that point in space where all of the acoustical wave shaping effects unify into one single wave front, typically referred to as the near field boundary, far field boundary, or summation boundary.

In many prior art systems, a concave progressive curved reflector is employed in order to obtain true hemispherical polar coverage. However, systems of this nature require higher ceilings to function properly, since a loudspeaker of this type must be placed at a listening distance which is at least eight times greater than the diameter of the reflector. Since most reflectors of this configuration are larger than 12 inches, the listening distance required for optimum performance would be greater than eight feet. As a result, the systems are highly effective in higher ceiling environments, but tend to be ineffective in low ceiling environments.

In general, prior art attempts to attain a true hemispherical spatial response in a low ceiling environment have resulted in compromised designs. Typically, these prior art systems incorporate one or more of the following shortcomings. One such common shortcoming is the existence of a high intensity lobe of acoustic energy directly on axis with the reflector. Usually the lobe of acoustic energy ranges between about 30° and 60° about the central axis of the system.

In addition, another difficulty typically encountered in prior art systems is a severe decrease of high frequency energy distribution at the wider points of the coverage pattern, usually beginning at about 45° from the central axis and continuing to about 90° therefrom. Furthermore, a significant increase in phase distortion is created from undesirable multiple reflections between the sound source and the reflector. In addition, a significant increase in intermodulation distortion is created due to the remodulation of one wave by another wave of a different frequency. This, additionally, generates an undesirable phase distortion.

Further drawbacks typically encountered with prior art systems is frequency selective distribution of the reproduced signal which creates a reduced bandwidth, "low fidelity" condition and a subsequent loss of aural articulation and intelligibility. Finally, spectral imbalance of the distribution pattern is also found, particularly unequal levels of low, mid-range, and high frequency signals at various angles within the 180° coverage pattern.

SUMMARY OF THE INVENTION

By employing the present invention, all of the difficulties and drawbacks of prior art loudspeaker constructions are eliminated and a low profile overhead loudspeaker system is achieved which controls and shapes the ultimate acoustical wave form produced thereby, achieving a system which is particularly wellsuited for use in low ceiling environments. In the present invention, a loudspeaker system is achieved which incorporates a uniquely constructed wave shaping and controlling member which is formed as an integral component of the speaker assembly. In this way, broad band, acoustical wave shaping and control is realized.

In accordance with a present invention, the wave shaping/controlling member is cooperatively associated with the drivers of the loudspeaker in a way which effects the critical acoustical loading and atmospheric coupling thereof, while controlling and shaping the ultimate acoustical wave form so that a hemispherical polar coverage pattern results. In the preferred configuration, the polar coverage pattern produced by the present invention is provided across the loudspeaker system's entire power bandwidth, beginning at an approximate distance of about three times the diameter of the acoustical source. As a result, an eight inch diameter loudspeaker is capable of providing the desired acoustical wave front at about two feet.

In accordance with the present invention, the desired acoustical system is achieved by attaching the wave shaping and controlling member of the present invention directly to the loudspeaker cabinet typically employed for a low ceiling, overhead sound system, with one or more drivers or speaker motors mounted in the cabinet. The uniquely constructed wave shaping and controlling member is specifically designed to receive and distribute the acoustical energy of the loudspeaker's driver so as to provide an acoustical energy field of a true broadband hemispherical pattern. Furthermore, the present invention produces the desired acoustical energy field within the system's power bandwidth, at a point of summation of approximately three times the acoustical source diameter.

In the preferred embodiment of the present invention, the wave shaping and controlling member is designed to be rigidly or securely affixed to the front of the loudspeaker enclosure, mechanically attached to the baffle of the loud speaker, or otherwise built into the construction of the enclosure during the fabrication or molding process as a homogeneous or integral component thereof. Regardless of the construction employed, the unique geometric contours of the wave shaping/controlling member are designed and positioned in the required critical acoustical fashion in order to achieve the desired broadband hemispherical polar coverage pattern.

As is more fully detailed below, the wave shaping and controlling member of the present invention comprises a combination of singular acoustical shaping and distribution devices which are individually designed to control specific and applicable sound bands of the audio spectrum. In this way, individual functions are performed, with each function representing a factor of the final acoustical summation product produced by the wave shaping/controlling member.

By employing the present invention, a loudspeaker system is achieved which controls and defines the wave shape and coverage patterns of the various frequency band widths, utilizing the natural characteristics of the wave itself, with no forced or artificial control. By using the following three elements, namely (1) a driver, (2) an enclosure, and (3) a uniquely constructed wave shaping and controlling member, a synergistic interaction is achieved which produces true hemispherical coverage patterns across the entire rated power bandwidth of the loud speaker.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following the detailed description taken in connection with the accompanying drawings, in which.

DETAILED DESCRIPTION

By referring to FIGS. 1–7, along with the following detailed discussion, the overall construction and operation of the present invention can best be understood. As will become evident to one of ordinary skill in the art, FIGS. 1–7 depict the preferred embodiment of the present invention. However, alternate constructions and variations of this invention can be made without departing from the scope of this invention. Consequently, it is to be understood that the construction shown in FIGS. 1–7 is provided for exemplary purposes only and is not intended to limit the present invention thereto.

As is well known in the industry, every speaker or acoustical system must handle seven acoustical modes of operation. These seven modes are reflection, diffraction, refraction, diffusion, coupling, loading, and summation. In order to produce a true hemispherical wavefront from a single loudspeaker enclosure, each of these modes must be carefully balanced and applied to the design. Since many of these modes are competing, each must be controlled in their own unique characteristic way, as they apply to the wavelength of the frequency being transmitted. By integrating these acoustical modes as well as the inherent natural wavefront shape of various frequencies, the desired operation and preferred wavefront pattern can be created.

Figure 1:
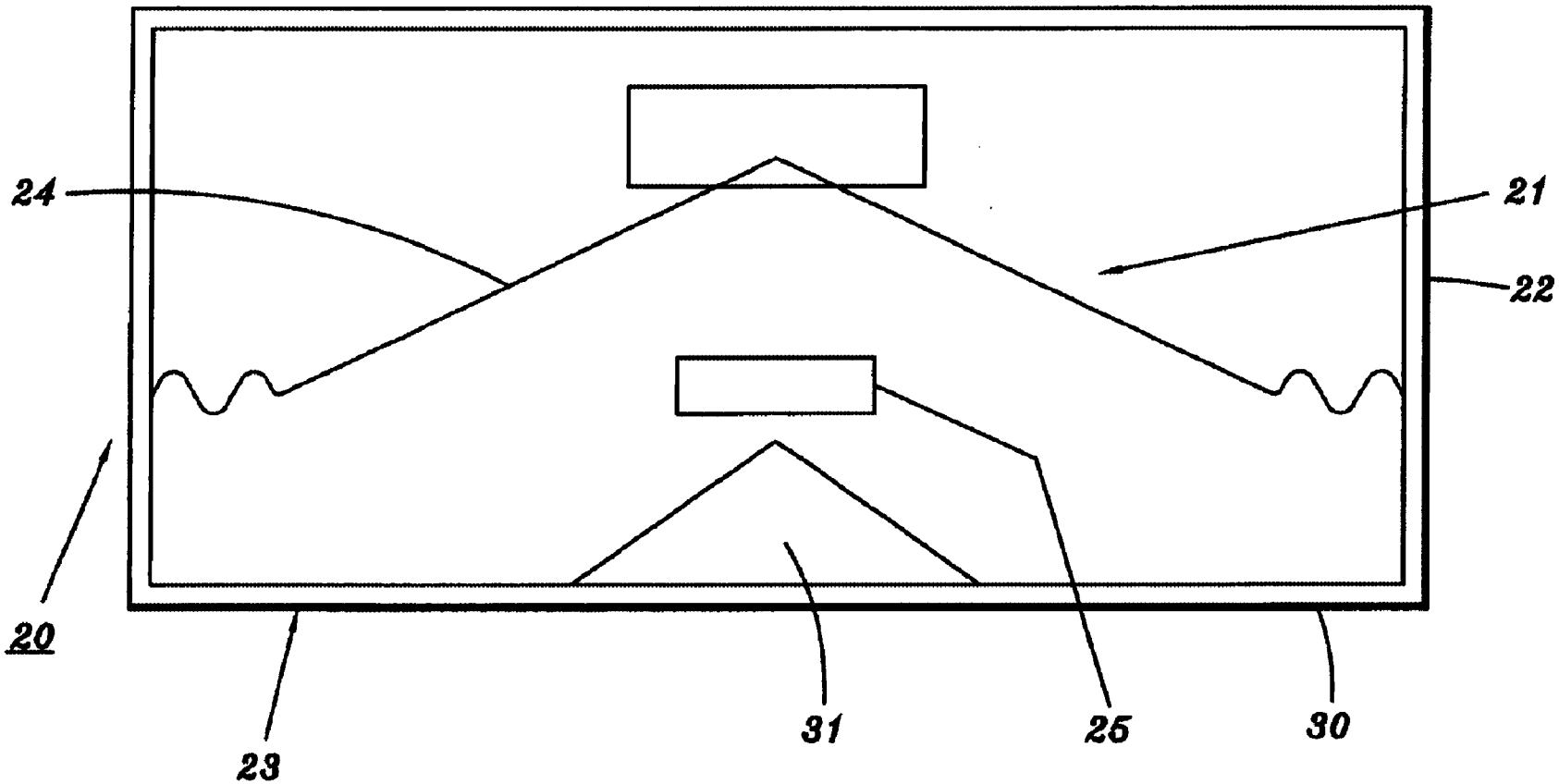
FIG. 1 is a cross-sectional, side elevation view of the loudspeaker or acoustical system of the present invention.
Figure 2:
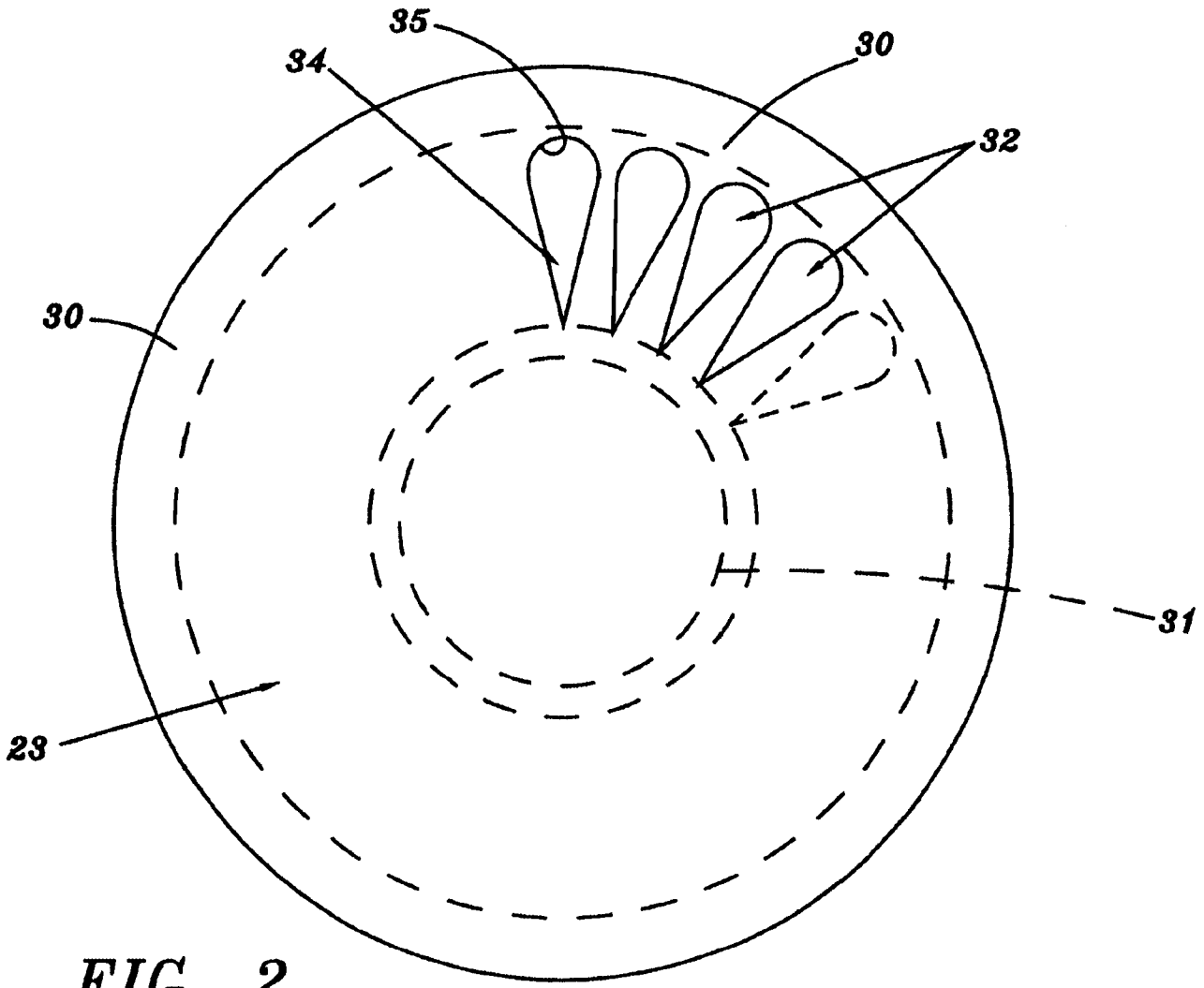
FIG. 2 is a front plan view of the loudspeaker or acoustical system of FIG. 1.

As shown in FIGS. 1 and 2, loudspeaker or acoustical system 20 of the present invention comprises a driver assembly 21, an enclosure 22, and a cooperatively associated wave shaping and controlling member 23. In the preferred construction of the present invention, driver assembly 21 comprises a low frequency driver 24 and a high frequency driver 25 cooperatively associated with each other.

In order to attain optimum results, driver assembly 21 is designed for optimum sensitivity or efficiency, bandwidth or frequency response, linearity or flatness of response, transient response, lack of distortion or colorations, power handling and maximum sound pressure level capability. In order to function in the intended manner, all of these qualities must be present in speaker or driver assembly 21, since enclosure 22 and wave shaping and controlling member 23 function as passive wave shaping and controlling devices, and cannot add to the purity, quality, or fidelity of the acoustical signal generated by driver assembly 21.

The principal unique aspect of the present invention is the construction and positioning of wave shaping and controlling member 23 relative to driver assembly 21. As discussed above, wave shaping and controlling member 23 is constructed for attachment to enclosure 22, a baffle associated with enclosure 22, or for being integrally formed with enclosure 22. However, regardless of the manner employed for cooperatively mounting wave shaping and controlling member 23 to enclosure 22, wave shaping and controlling member 23 is designed to distribute the acoustical energy of driver assembly 21 so as to provide an acoustical energy field of a true hemispherical pattern, within the system's power bandwidth. In addition, as previously detailed, the present invention is constructed for producing the acoustical energy field in the desired hemispherical pattern at a point of summation of approximately three times the diameter of the acoustical source.

In order to achieve the desired results, wave shaping and controlling member 23 comprises a substantially flat plate 30 on which incidence/coincidence acoustic reflector 31 is mounted, substantially at the center of plate 30. In addition, a plurality of controlled, variable impedance, acoustical diffusion filter forming slots or baffles 32 are formed in plate 30. In the preferred embodiment, each of a plurality of slots/baffles 32 comprise identical sizes and shapes, and are formed in plate 30 peripherally surrounding incidence/coincidence reflector 31. As further detailed below, slots/baffles 32 extend radially outwardly from reflector 31 over the balance of the active acoustical source.

By referring to FIGS. 1 and 2, along with the following detailed discussion, the preferred construction of incidence/coincidence reflector 31 can best be understood. As detailed above, reflector 31 is mounted to plate 30, substantially at its center, and comprises a generally conical shape. However, the actual shape of reflector 31 or its acoustic profile is constructed to redirect or otherwise distribute the upper mid-range frequency and high frequency planar pressure waves through, primarily, incidence/coincidence reflection and, secondarily, through surface/edge diffraction in accordance with the desired radiation polar pattern.

Figure 3:
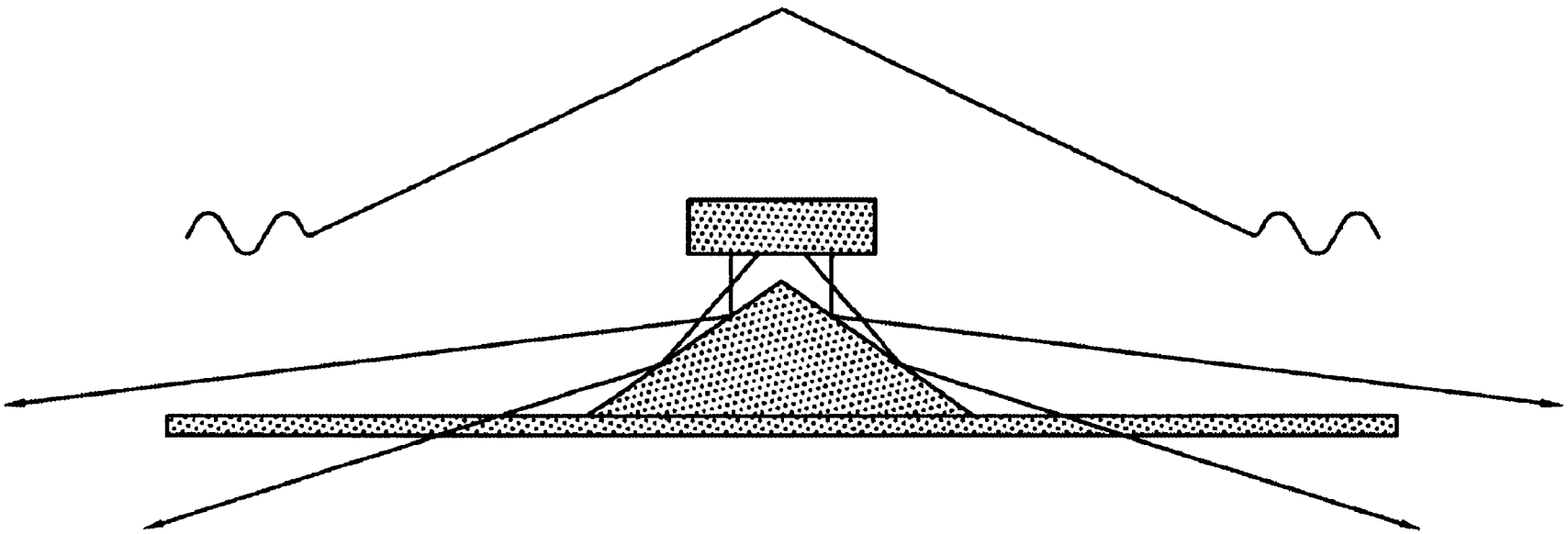
FIGS. 3–7 are diagrammatic side elevation views of the loudspeaker or acoustical system of the present invention depicting various acoustical ray patterns produced by the system of the present invention.
Figure 4:
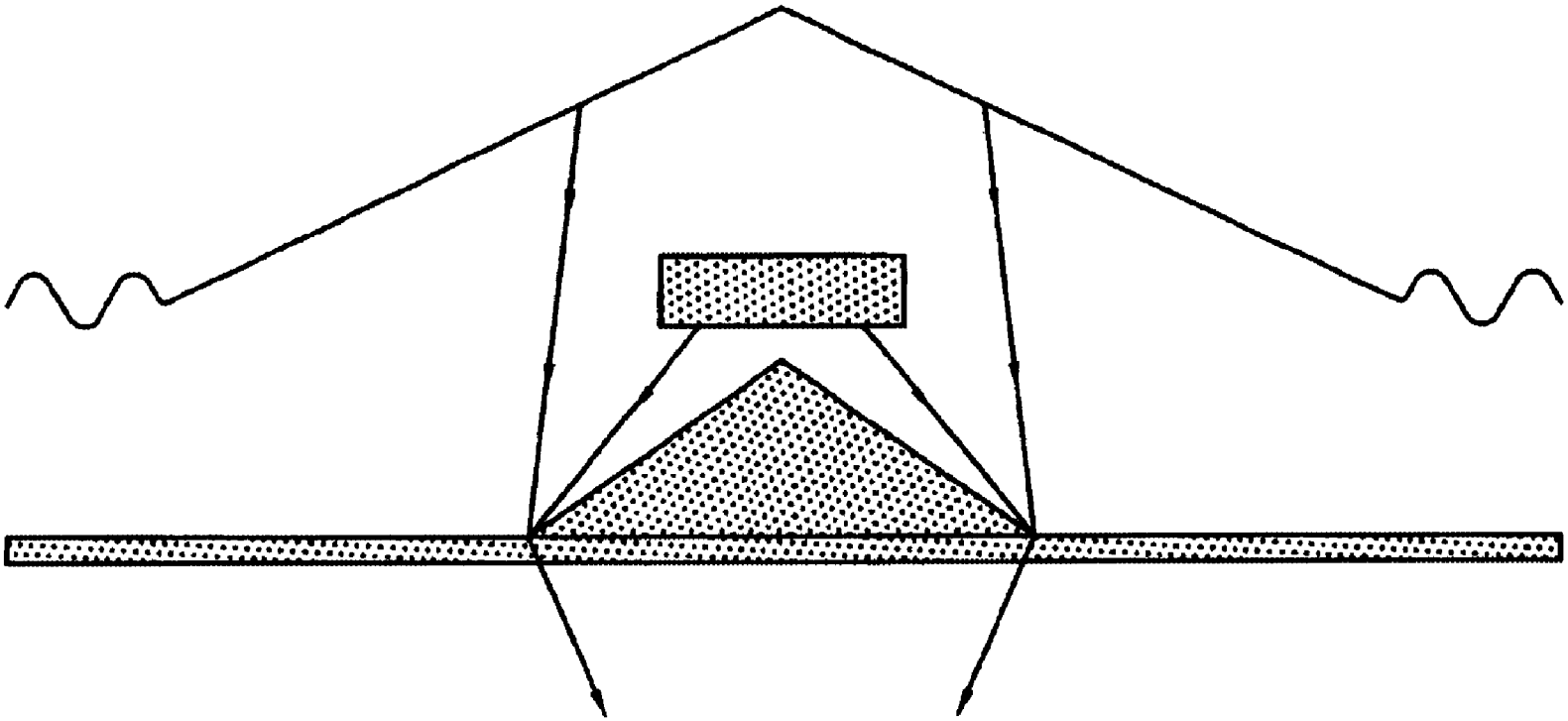

The acoustical ray pattern produced by reflector 31 in providing the incident/coincident reflection is diagrammatically depicted in FIG. 3. Similarly, the acoustical ray pattern produced by reflector 31 in providing surface/edge diffraction is diagrammatically depicted in FIG. 4. In order to achieve these desired effects, basic physical laws concerning the acoustical phenomena and sound wave behavior for reflection and diffractions are utilized.

Baffles/slots 32 formed in plate 30 are designed to control the distribution of the upper low frequency waves and lower mid-range frequency waves through controlled variable impedance and acoustical pressure diffusion and aperture refraction. In the preferred embodiment, slots/baffles 32 are not linear, but represent a geometric form which defines an exponentially progressive set of slots and baffles which complement each other in their acoustic function.

As best seen in FIG. 2, the form of each slot/baffle 32 begins at the outer periphery of reflector 31 and proceeds in a radially outwardly extending manner towards the rim of plate 30. Furthermore, slots/baffles 32 are formed in plate 30 in juxtaposed, spaced, adjacent relationship to each other peripherally surrounding reflector 31 substantially in its entirety. As a result, substantially the entire plate 30 incorporates slot/baffles 32 formed therein.

As depicted in FIG. 2, each slot/baffle 32 comprises a lower portion 34 consisting of substantially V-shaped diverging edges which extend outwardly to upper proportion 35, which comprises an arcuately curved, concave edge. As is more fully detailed below, lower energy waves pass through lower portion 34, while higher energy waves pass through upper proportion 35.

Figure 5:
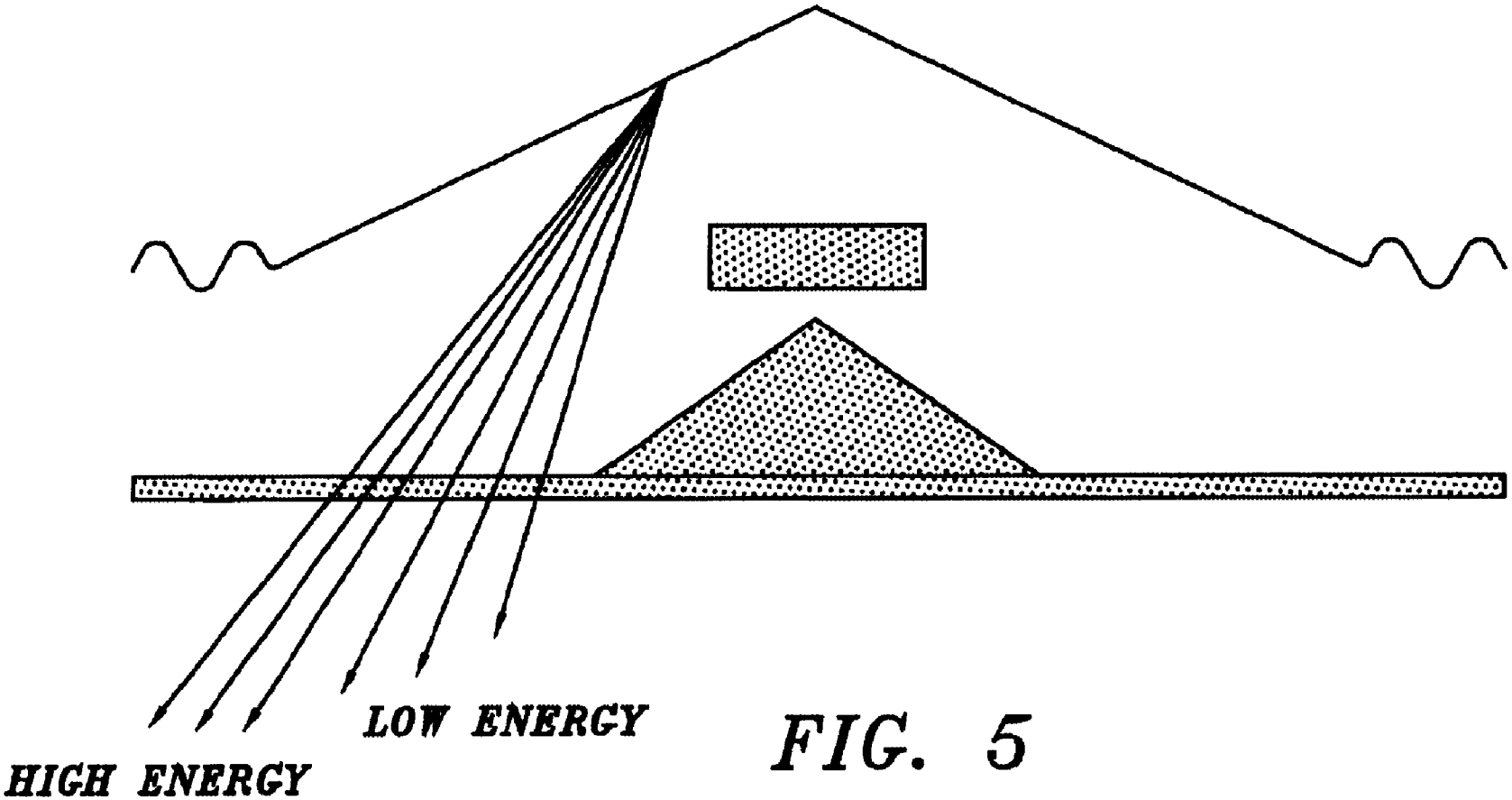
Figure 6:
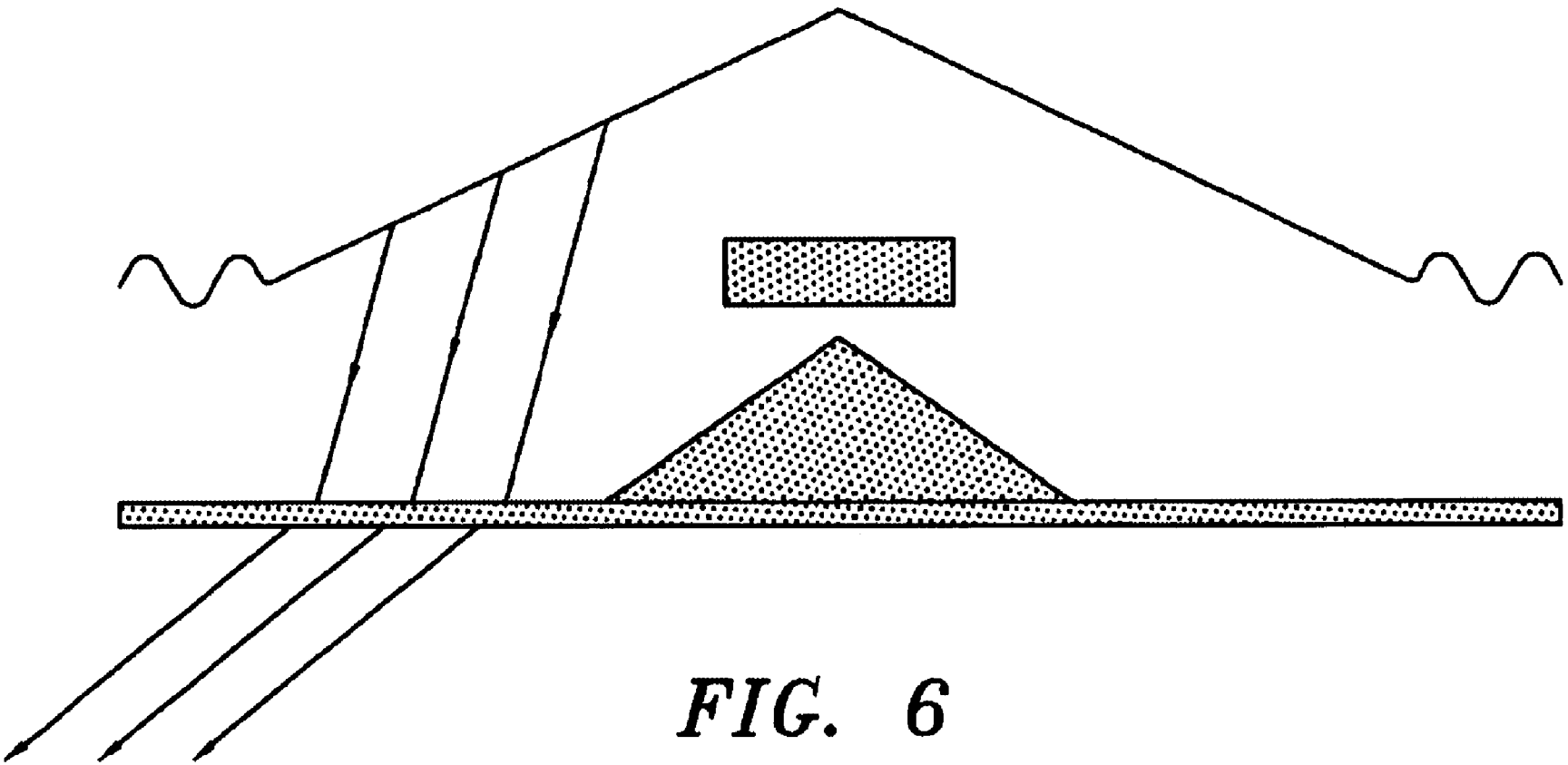
Figure 7:
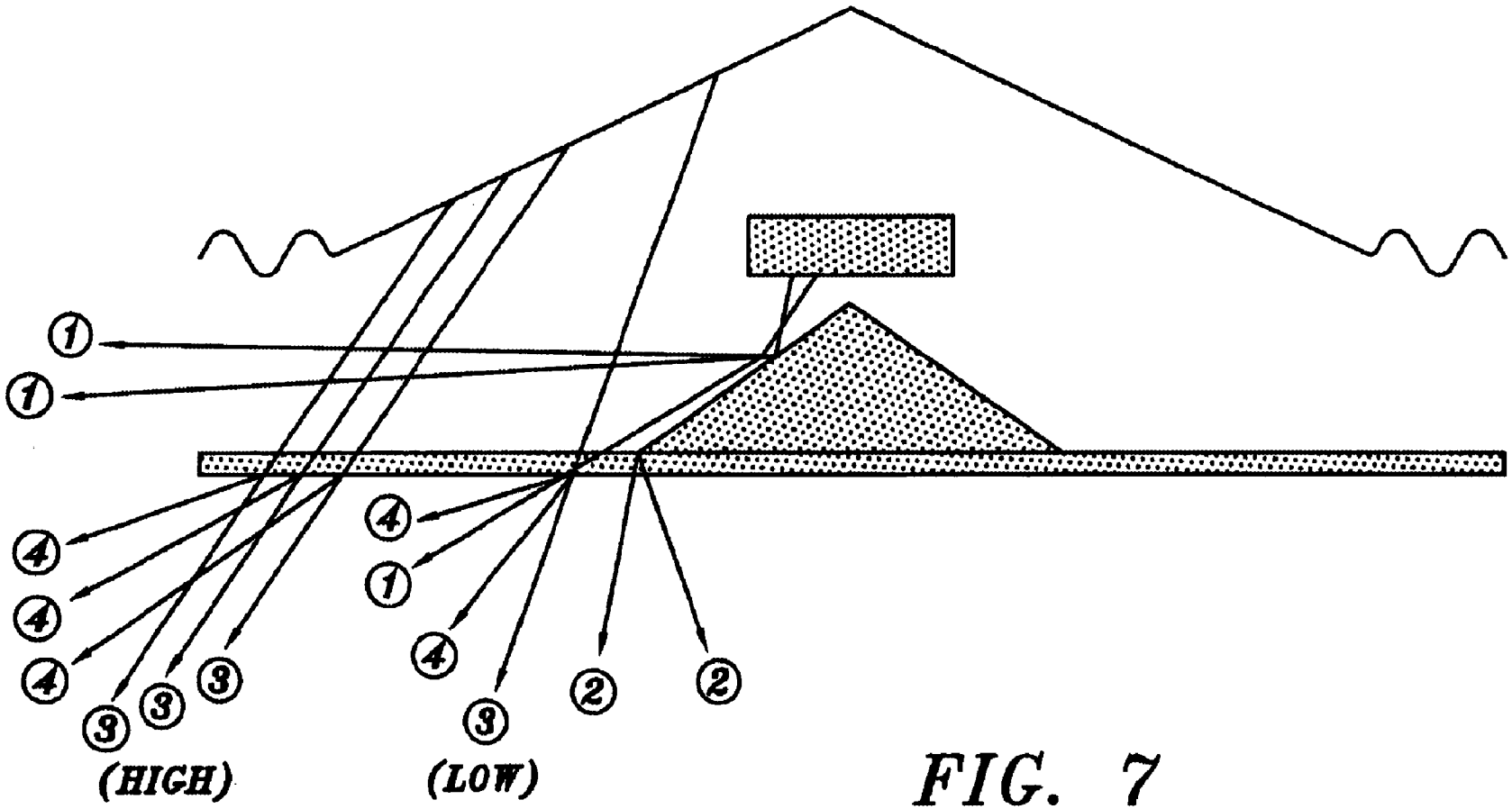

By referring to FIG. 5, the acoustical ray pattern produced by slots/baffles 32 in providing controlled variable impedance diffusion filtering is provided. In addition, FIG. 6 displays the acoustical ray pattern produced by slots/baffles 32 due to aperture refraction.

In the preferred configuration, the mathematical, geometric curve which defines the shape of slots/baffles 32 is symmetrical in both radial and annular form about the circumference of reflector 31. In order to achieve the desired effect, the basic physical laws concerning acoustical phenomena for aperture impedance and refraction are utilized.

By constructing wave shaping and controlling member 23 in the manner detailed above with uniquely configured reflector 31 and slots/baffles 32 formed on plate 30, a synergistic interaction is realized which produces results heretofore believed to be unattainable. However, as diagrammatically depicted in FIG. 7, the present invention combines separate and independent physical factors of acoustical phenomena, each of which are diagrammatically represented in FIG. 7 by a numerically identified ray pattern. In this regard, incident/coincident reflection (1), surface/edge diffraction (2), controlled variable impedance diffusion filtering (3), and aperture refraction (4) are all depicted and combine to produce a single synergistic result. This final result is the product wave, which represents the acoustical summation of the various factors and determining the shape of the final or ultimate wavefront.

In providing these desired, synergistic results detailed above, the progression of the shape of reflector 31 describes a form factor that is acoustically complementary to the desired ray pattern of the driver's natural upper midrange and high frequency planar wave dispersion. The progression of the form of slots/baffles 32 defines the inverse of the natural exponential pressure distribution of the spherical waves in the upper bass and lower midrange frequencies.

The diaphragm of each driver or the moving mass of the loudspeaker motor comprises a fixed diameter and shape, and all of its acoustical, mechanical, and dimensional parameters are of a finite nature. Therefore, these values establish the reference base line for the profile calculations of reflector 31 and slots/baffles 32. As a result, the exponential forms which comprise the shape of reflector 31 and slots/baffles 32 must be variable, while being specific relative to a particular diaphragm, in order to realize the desired design objectives.

In accordance with the present invention, the acoustical properties of reflector 31 and slots/baffles 32 combine algebraically to produce the various acoustical control products which, in turn, defines the performance qualities of the ultimate objective—that being the acoustical spatial wave shaping which describes a true hemispherical polar-coverage pattern of acoustical pressure waves and consequently acoustical power (energy) distribution. This occurs in front of the loudspeaker, beyond the near field and across the system's entire rated power bandwidth at a distant point of summation in space, of about three times the linear distance of the source diameter—the far field.

In producing the loudspeaker or acoustical system of the present invention, wave shaping and controlling member 23 may be fabricated from any desired conventional materials. If desired, wave shaping and controlling member 23 may be formed from the same material used for constructing enclosure 22. Typically, the following materials may be employed for constructing wave shaping and controlling member 23, as well as enclosure 22, fiberglass, plastics such as acrylics, styrenes, PVC, and polycarbonates and/or polypropylenes, structural foams, molded resins, and aluminum or steel bonded to sound dampening materials.

Any material selected is limited by its intrinsic characteristics, namely its acoustical properties and its structural integrity. However, properties such as density, thickness, hardness and toughness are qualities to be evaluated in selecting a particular material for use in this acoustical application.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A loudspeaker system constructed for controlling and shaping the acoustical waveform produced thereby, said system comprising:

A. at least one loudspeaker driver for generating sound energy in response to the activation thereof;

B. a housing comprising a portal zone and constructed for supportingly retaining the loudspeaker driver in cooperating relationship with the portal zone; and C. a wave shaping and controlling member comprising a. a substantially flat plate cooperatively associated with the portal of the housing, b. constructed for directly receiving the acoustical wave patterns produced by the loudspeaker driver and directed toward the portal, and controllably shaping the wave patterns by incident/coincident reflection, surface/edge diffraction, controlled variable impedance diffusion filtering, and aperture refraction, c. incorporating an acoustic reflector mounted to the flat plate and positioned extending therefrom inwardly toward the loudspeaker driver, and d. comprising a plurality of slots or baffles 1. formed in said flat plate and positioned for providing controlled, variable impedance acoustical diffusion filtering of the acoustical wave directed thereto, 2. each of said slots/baffles substantially identical in size and shape, formed in said flat plate in peripheral surrounding relationship with said acoustic reflector, and positioned in juxtaposed, adjacent, side-to-side relationship with each other defining a substantially circular array, and 3. each of said slots/baffles comprising an elongated aperture comprising a first portion comprising a substantially V-shaped edge and a second portion comprising an arcuately curved, concave edge interconnected and blended with the V-shaped edge defining the first portion;

whereby a resulting final or ultimate waveform is produced which represents the acoustical summation of all factors.

2. The loudspeaker system defined in claim 1, wherein the acoustic reflector is further defined as comprising a shape constructed to redirect or distribute the upper mid-range frequency and high frequency planer pressure waves through incidence/coincidence reflection and surface/edge diffraction.

3. The loudspeaker system defined in claim 2, wherein the acoustic reflector is further defined as comprising a substantially conical shape mounted to the substantially flat plate in cooperating relationship with the centerpoint of said plate.

4. The loudspeaker system defined in claim 1, wherein each of said slots/baffles are further defined as comprising an elongated aperture having a geometric form constructed to control the distribution of upper low frequency waves and lower mid-range frequency waves through controlled variable impedance, acoustical pressure diffusion, and aperture refraction.

5. The loudspeaker system defined in claim 1, wherein the elongated aperture defining each slot/baffle is further defined as being symmetrical in both radial and annular form about the circumference of the acoustic reflector.

6. The loudspeaker system defined in claim 1, wherein the substantially flat plate is associated with the portal zone of the housing by employing one selected from the group consisting of physical attachment, mounting to a baffle, and integral formation therewith.

7. The loudspeaker system defined in claim 1, wherein said wave shaping member and said housing are constructed from one selected from the group consisting of fiberglass, plastics such as acrylics, styrenes, PVC, and polycarbonates and/or polypropylenes, structural foams, molded resins, and aluminum or steel bonded to sound dampening materials.

* * * * *